United States Patent [19]

Demartini

[11] Patent Number: 4,497,146

[45] Date of Patent: Feb. 5, 1985

[54] HANGERS FOR RAIN GUTTER DEVICES

[76] Inventor: Robert J. Demartini, 3500 Canter La., Raleigh, N.C. 27604

[21] Appl. No.: 395,852

[22] Filed: Jul. 6, 1982

[51] Int. Cl.[3] ..... E04D 13/06

[52] U.S. Cl. ..... 52/12; 52/11

[58] Field of Search ..... 52/12–16, 52/11; 210/474

[56] References Cited

U.S. PATENT DOCUMENTS

| | | | |
|---|---|---|---|
| 870,165 | 11/1907 | Hagler et al. | 210/474 |
| 2,431,012 | 11/1947 | Alig | 248/48.1 |
| 2,569,568 | 10/1951 | Lipshaw | 210/474 |
| 2,672,832 | 3/1954 | Goetz | 52/12 |
| 2,873,700 | 2/1959 | Heier | 52/12 |
| 2,988,226 | 6/1961 | Campbell | 52/12 X |

*Primary Examiner*—Alfred C. Perham
*Attorney, Agent, or Firm*—William G. Rhines

[57] ABSTRACT

Embodiments of the present disclosure include deflector support means for supporting the underside of a rain gutter deflector, said deflector support means including fastening means for retainably positioning said deflector support means with respect to the gutter with which said deflector means is to be associated characterized by being formed from strips of rigid material, having a straight, downward-sloping upper section and an adjacent downward curved portion for supporting the underside of such a deflector, and a lower downward directed segment adapted for affixation to the top front lip of an associated gutter either directly or via an intermediate gutter support ferrule.

4 Claims, 4 Drawing Figures

HANGERS FOR RAIN GUTTER DEVICES

BACKGROUND OF INVENTION

It is known in the construction industry, particularly the building of dwelling houses and other buildings, to erect a rain gutter at roof edges, such gutters usually have associated down-pipes. By these means, water coming off the roof may be intercepted, collected, and diverted into desired locations. This avoids splashing, "trenching", flooding, and other undesired effects. A persistant problem with such gutters is that they collect leaves, sticks, roof granules, pine needles, and other debris as well. This causes the gutters and/or down-pipes to become blocked. As a result, water backs up, causing it to flood over the gutter edges and, sometimes down the side of the building, and permitting freezing in the gutter to occur. It may also or alternatively cause the gutter to accumulate pools of water which do not drain off rapidly or readily and cause weeping and/or rusting of joint areas, and sometimes freeze into ice in cold weather.

In an attempt to overcome the necessity for manually clearing the gutters and/or down pipes periodically, usually by a scending a ladder, various proposals have been made. They range from applying screens to cover the gutter openings, to deflector means. The general experience has been that the installation of screens basically does little more than relocate the problem of debris blocking from the gutter to the screen, necessitating periodic manual removal anyway. From time to time, it has been proposed to use "deflector" type devices, by which it was contented it would be possible to redirect the flow of rainwater coming off of the top surface of a roof into a gutter, free of debris which will, in the meantime have been ejected off of the roof onto the ground. Some of such deflector type devices include a lower arcuate surface by which, theoretically, water coming down the roof will, by the effect of surface tension, be forced to follow around the arcuate surface. By this means, it was postulated that the water may be deposited in the gutter which is positioned inside and below the arcuate surface, while debris carried by the water is jettisoned off, more or less tangentially to the curved surface, and falls to the ground. In this connection, reference is made to the following U.S. Patents: Van Horn U.S. Pat. No. 546,042; Nye U.S. Pat. No. 603,611; Cassen U.S. Pat. No. 836,012; Cassen U.S. Pat. No. 891,405; Yates U.S. Pat. No. 1,101,047; Goetz U.S. Pat. No. 2,672,832; Bartholemew U.S. Pat. No. 2,669,950; Heier U.S. Pat. No. 2,873,700; Matthews et al U.S. Pat. No. 2,935,954; Foster U.S. Pat. No. 3,388,555; Homa U.S. Pat. No. 3,507,396; and Zukauskas U.S. Pat. No. 3,950,951.

Although the basic theory has been available for some time, as far as is now known, it has never actually been adopted or used in what might reasonably be described as a commerical embodiment. In part, this may be because there is little to impell builder-contractors to incur whatever extra cost or expense is involved in making such installation initially. Once a conventional system has been installed, to "retrofit" an existing installation involves troublesome, time-consuming, costly, basic and/or aesthetically undesirable structural alterations to the existing gutter installation and, in many cases, to the building with which it is associated. It also appears that a reason why the concept has not found significant or widespread use is because, as disclosed to date, it didn't work with a sufficient degree of reliability or effectiveness to make it practically feasible. That is, practicing the extant disclosures as taught, it has been found that surface tension of the water often is not sufficient to contain the water through an arcuate travel path against counter-forces typically encountered from factors such as a large volume of water, steep slopes, "rivuleting", etc. Whatever the particular reasons, the impressive fact is the lack of their adoption and use to date, in spite of the ovbious advantages which might occur if they could be used, in light of the costs and difficulty of obtaining maintenance labor, particularly in recent times. To overcome these difficulties, I have invented and disclosed certain deflector devices, which are particularly adapted for retrofitting existing gutter installations as well as for new installations, some embodiments of which are adapted for installation without the underside of their upper surfaces necessarily being contiguous with the upper surface of the associated roofing, so as to facilitate installation without having to remove or lower the gutters themselves and to produce a finished installation which is aesthetically more pleasing.

The installation of such devices, as noted above, presents certain practical difficulties and typically has involved hardware that is not altogether satisfactory and is relatively complex structurally and difficult to install, often involving relocation of the associated gutter. Some such hardware is shown in the U.S. Pat. Nos. issued to Nye as 836,012, to Goetz as 2,672,832, and to Matthews et al as 2,935,954.

Accordingly, it is an object of this invention to provide bracket means for rain gutter deflectors.

Another object of this invention is to provide such means so structured as to be adapted for use with rain gutters of established design and construction.

Still another object of this invention is to provide means for achieving the foregoing without requiring relocation of the associated gutter means.

Yet another object of this invention is to provide means for achieving the foregoing which will support such deflector means while affixed to the gutter with which it is associated.

SUMMARY OF THE INVENTION

Desired objectives may be achieved through practice of the present invention, embodiments of which include deflector support means for supporting the underside of a rain gutter deflector, said deflector support means including fastening means for retainably positioning said deflector support means with respect to the gutter with which said deflector means is to be associated characterized by being formed from strips of rigid material, having a straight, downward-sloping upper section and an adjacent downward curved position for supporting the underside of such a deflector, and a lower downward directed segment adapted for affixation to the top front lip of an associated gutter either directly or via an intermediate gutter support ferrule.

DESCRIPTION OF DRAWINGS

This invention may be understood from the description which follows and from the attached drawing in which.

DESCRIPTION OF PREFERRED EMBODIMENTS

Figure 1:
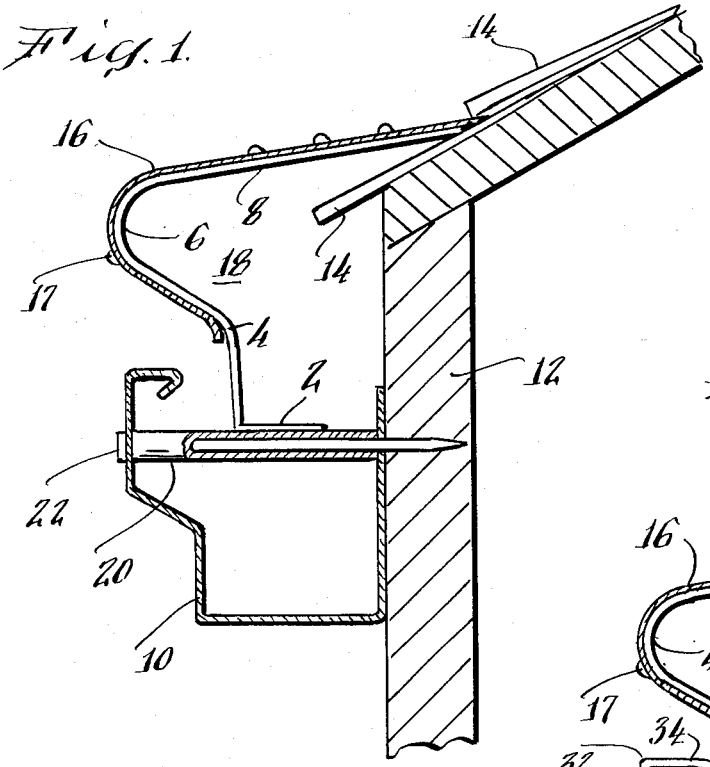
FIG. 1 is a cross-sectional drawing of an embodiment of this invention.

Referring first to FIG. 1, there is depicted a cross-section of a device 18 which embodies this invention. As shown, it is in the form of a strap made from metal, plastic or other suitable material, which has been so formed as to have a horizontal, ferrule contact segment 2, adjacent a riser segment 4 that is adjacent to a curved segment 6, with the latter adjacent to an upper support segment 8. The ferrule segment 2 is affixed to a ferrule 20 in the form of a cylindrical metal tube which may be positioned inside a standard rain gutter 10, with a bolt 22 extending through the ferrule 20 and through holes in the front and back of the rain gutter 10, and into the front 12 of a building. By this means, the device 18 is fixed positionally with respect to the gutter, the building, and the roof of the building. A number of such devices may be similarly affixed to the building along the length of gutter. Thereafter, a deflector 16, of the type which causes water to be deflected by surface tension into the gutter while leaves, debris, and the like are jettisoned over the edge, may be positioned on top of the devices 18 so that it is supported by the upper support segment 8 of each. So positioned, the deflector 16 may be affixed to the device 18 by means of a sheet metal screw 17 or other fastening means.

It should be noted that with this invention, it is not necessary to remove, replace, or lower the gutter, in order to accomodate the installation of deflectors of the type hereinbefore described, particularly when they are installed with their upper flat surface at a shallower angle than the angle of the roof. This is advantageous as to cost as well as insofar as preserving the architectural aesthetics of the building.

Figure 2:
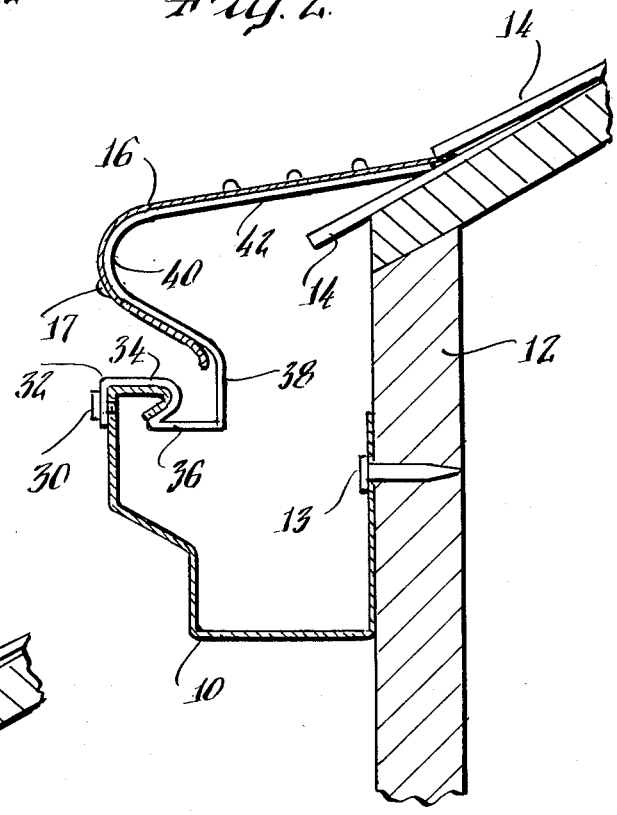
FIG. 2 is a cross sectional drawing of another embodiment of this invention.

FIG. 2 illustrates another embodiment of this invention 28, made from a continuous strip of metal, plastic or other suitable material. It includes a front segment 32 and lip top segment 34 for affixation to the front and top of the front lip of the gutter 10 by means of sheet metal screw 30, a set-back segment 36, a riser segment 38, a curved segment 40 and a top flat segment 42. Several such devices may be arrayed down the length of the gutter, so as to have a deflector 16 positioned thereon and attached thereto by means of sheet metal screws 17. Since the gutter 10 is affixed to the side of the building 12 by means of lag bolts or screws 13 as is known per se, the effect is to provide a means for positionally fixing the deflector 16 without the necessity of relocating the gutter 10, again, particularly where the top surface of the deflector is at a shallower angle than is the line of the roof, at reduced cost and enhanced preservation of the architectural aethetics.

Figure 3:
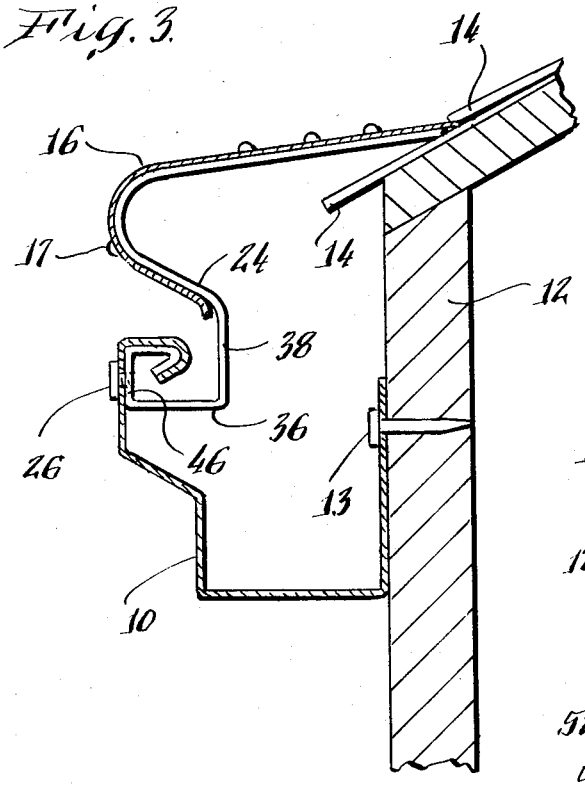
FIG. 3 is a cross-sectional drawing of another embodiment of this invention.

Similar results are achievable with the embodiment of this invention shown in FIG. 3 which corresponds in structural segments substantially to the embodiment shown in FIG. 2, except that the front lip segment 46 is adapted to being affixed to the inside of the front lip of the gutter 10 by a sheet metal screw 26, rather than around the top and outside front of the front lip of the gutter 10.

From the foregoing, it will be apparent that it is possible through practice of this invention to provide a variety of effective, relatively simple structurally, and inexpensive means for positionally fixing rain deflectors of the type described to their associated rain gutters.

Figure 4:
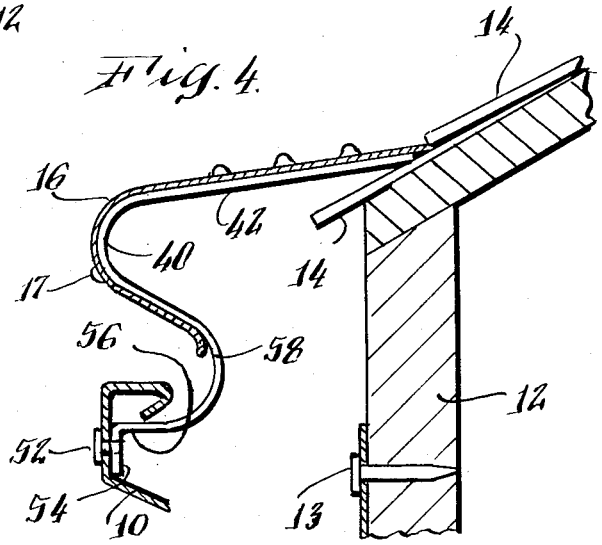
FIG. 4 is a cross-sectional drawing of another embodiment of this invention.

Similarly, utilizing the embodiment of this invention shown in FIG. 4, the aforementioned advantages may also be achieved, with the additional advantage that it may be temporarily positioned atop the front edge of the associated gutter before it is finally affixed thereto, to facilitate attaching the deflector, making installation adjustments, etc. In this embodiment, the hanger, in addition to a deflector supporting top straight section 42 and an adjacent curved segment 40, has an outward extending reverse curve section 58 which extends to a substantially horizontal leg 56 and ends in a downward facing outermost portion 54. In use, the support may be positioned with the upperside of the leg 56 under the lip of the associated gutter 10, with the outer side of the downward segment 54 more or less abutting the inner surface of the front wall of the gutter 10. Later, for example, after other desired installation tasks are complete, the downward segment 54 may be affixed to the gutter 10 by means of a sheet metal screw 52 or other known per se affixation means. Alternatively, the leg 56 may be positioned atop the lip of the gutter, for example, if it is wooden. It should be noted that the embodiments which have been disclosed and discussed are all characterized by having an upper segment and an adjacent curved segment for supporting contact with the underside of the deflector, a riser segment to retain the deflector supporting segments in elevated position, and affixation means for affixing the portion below the riser segments of the associated gutter, either directly or via an intermediate support member such as a gutter support ferrule. Thus, a number of other variants may be incorporated into embodiments of this invention.

Additionally, a wide variety of materials may be utilized to produce devices according to the present invention. Galvanized steel is useful, as also is aluminum, particularly since it may be anodized to give it desired surface characteristics. Various plastics may also be used to particular advantage since they are easily formed according to technology which is known per se into complex and intricate shapes and configurations, are durable and weather resistant with minimum maintenance requirements, and may be made inherently to have desired surface characteristics. All of the foregoing are within the skills, competance and knowledge of the person with ordinary skills in the cognizant arts.

Accordingly, it is to be understood that the embodiments of this invention herein described are by way of illustration and not of limitation, and that a wide variety of embodiments may be made without departing from the spirit or scope of this invention.

I claim:

1. A device for positionally fixing a rain deflector of the type which utilizes the surface tension of roof runoff rainwater to cause the water to follow the arcuate surface of the device to an associated rain gutter which has a front lip while causing leaves and other debris to be jettisoned away from said gutter comprising a strip-like continuum having an upper support segment and an arcuate segment adapted to be juxtaposed to the underside of the deflector to be associated therewith, and a riser segment for positioning the height of said upper support segment and said arcuate segment with respect to said gutter, and affixation means for positionally affixing said device with respect to said gutter, wherein said affixation means comprises a set back segment and a lip-front segment for affixation to the front lip of said gutter.

2. The device described in claim 1 wherein said lip front segment is oriented upward with respect to said set-back segment and is adapted for juxtapositioning to the inside of the front lip of said gutter.

3. The device described in claim 1 wherein said lip front segment is oriented downward with respect to said set-back segment and is separated therefrom by a lip top segment, said lip top segment and said lip front segment being adapted for juxtapositioning to the top and front respectively of said gutter.

4. A device for positionally fixing a rain deflector of the type which utilizes the surface tension of roof run-off rainwater to cause the water to follow the arcuate surface of the device to an associated rain gutter which has a front lip while causing leaves and other debris to be jettisoned away from said gutter comprising a strip-like continuum having an upper support segment and an arcuate segment adapted to be juxtaposed to the underside of the deflector to be associated therewith, and a riser segment for positioning the height of said upper support segment and said arcuate segment with respect to said gutter, and affixation means for positionally affixing said device with respect to said gutter, wherein the affixation means comprises a horizontal segment adjacent said riser segment for positioning along the front edge of said gutter and a downward directed end segment adjacent said horizontal segment for affixation to the outer wall of said gutter.

* * * * *